US006497471B1

(12) United States Patent
Gargir

(10) Patent No.: US 6,497,471 B1
(45) Date of Patent: Dec. 24, 2002

(54) SERVICE STATION FOR INKJET PRINTHEADS

(75) Inventor: Eyal Gargir, Kfar Saba (IL)

(73) Assignee: Aprion Digital Ltd., Netanya (IL)

( * ) Notice: Subject to any disclaimer, the term of this patent is extended or adjusted under 35 U.S.C. 154(b) by 0 days.

(21) Appl. No.: 09/570,810

(22) Filed: May 15, 2000

(51) Int. Cl.[7] ..... B41J 2/165

(52) U.S. Cl. ..... 347/28; 347/29; 347/30; 347/33

(58) Field of Search ..... 347/28, 29, 30, 347/33

(56) References Cited

U.S. PATENT DOCUMENTS

| | | | | | |
|---|---|---|---|---|---|
| 4,170,016 | A | * | 10/1979 | Geil | 347/30 |
| 4,571,601 | A | * | 2/1986 | Teshima | 347/33 |
| 5,055,856 | A | * | 10/1991 | Tomii et al. | 347/30 |
| 5,786,830 | A | | 7/1998 | Su et al. | |
| 5,815,176 | A | | 9/1998 | Rotering | |
| 5,900,892 | A | * | 5/1999 | Mantell et al. | 347/45 |
| 6,158,838 | A | * | 12/2000 | Capurso | 347/28 |

FOREIGN PATENT DOCUMENTS

| | | | | | |
|---|---|---|---|---|---|
| JP | 62-77944 | A | * | 4/1987 | 347/28 |
| JP | 62-138373 | A | * | 6/1987 | 347/33 |
| JP | 4-39055 | A | * | 2/1992 | 347/28 |
| WO | WO 96/15908 | | | 5/1996 | |

* cited by examiner

*Primary Examiner*—Huan Tran
(74) *Attorney, Agent, or Firm*—Eitan, Pearl, Latzer & Cohen-Zedek

(57) ABSTRACT

A service station system for cleaning printheads, particularly inkjet printheads is provided. The service station includes a body having a seal attached thereto and at least one pressure operated sprayer attached to the body within an area demarcated by the seal. Each sprayer includes a bent cap, which enables spraying a cleaning agent at a predetermined spray angle. The sprayers are positioned so that substantially all of the nozzle plate will be wetted by the cleaning agent when the seal, the body and the nozzle plate are positioned to form an enclosed volume. The service station also includes a pressure release valve to keep the pressure within the enclosed volume at atmospheric level during spraying.

7 Claims, 9 Drawing Sheets

SERVICE STATION FOR INKJET PRINTHEADS

FIELD OF THE INVENTION

The present invention relates generally to a system for cleaning printheads and more particularly to a service station and method for cleaning inkjet printheads.

BACKGROUND OF THE INVENTION

Inkjet printheads are widely used and well known in the art. One type of inkjet printhead is based on drop-on-demand systems that use either piezoelectric or thermal printhead technologies.

In high-resolution drop-on-demand inkjet printing, very small ink droplets are ejected through tiny apertures in a nozzle plate. Contaminants, such as dust particles and paper fibers, tend to accumulate in the vicinity of these apertures, interfering with the ejection of the ink droplets. In addition, modem ink formulations contain, among other components, pigments, resins, and fast drying accelerators When the printer is not in use, these components, particularly pigments, have a tendency to dry out, blocking the nozzle apertures of the printhead. In addition, they can become so hard that they scratch the face of the nozzle plate, degrading inkjet accuracy.

In order to avoid accumulation of ink residues, dust and print fibers when the printhead is not in use, service stations are installed in printing machines. These stations periodically clean the nozzle plate of the printheads, removing contaminants and residues.

Many types of service stations are known in the art. Usually, during periods of non-use, the service stations cap the system, sealing the nozzles from contamination and drying. Some capping systems also facilitate priming of the printhead by drawing a vacuum on the printhead. During maintenance, many service stations cause ejection of a number of ink drops through each of the nozzle apertures of the printhead. The droplet ejection process is known as spitting and the ejected ink is collected in a spittoon that is part of the service station.

Most service stations use an elastomeric wiper that wipes the nozzle plate and removes ink residues, paper dust and other debris that have collected during use. An example of such a service station is disclosed in PCT Patent Publication WO 9615908. In '908, the cleaning and sealing station has among other features, a wiper, a sealing cap, and a suction element for withdrawing excess ink.

Other approaches or refinements to maintaining a clean nozzle surface on inkjet printheads are discussed in U.S. Pat. Nos. 6,786,830 and 5,815,176. The former teaches a station which uses a wiper with an adaptive wiping speed while the latter describes the use of a multi-finned wiping system.

SUMMARY OF THE INVENTION

The present invention describes a method for cleaning the nozzle plate of printheads by using at least one sprayer to spray a liquid cleaning agent onto a nozzle plate prior to wiping. The sprayed agent improves the efficiency of cleaning in several ways. It thins any liquid ink left on the nozzle plate and dissolves solid pigment residue stuck to the plate. It decreases the drying rate of fast drying inks and acts as a lubricant for the wiper, generally preventing scratches.

The present invention teaches a service station system for cleaning a printhead that includes a translational means for bringing the service station into proximity with the printhead. It also includes a cleaning agent means for distributing a cleaning agent over a printing face of the printhead when the service station is in proximity with the printhead. Finally, the system includes a wiper for wiping the cleaning agent off the printing face.

The translational means can either translate the service station with respect to the printhead or vice versa. Similarly, the translational means can translate the printhead with respect to the wiper or vice versa.

In an embodiment of the present invention, the cleaning agent means for distributing a cleaning agent is at least one sprayer.

In one embodiment the service station system can be used with an inkjet printhead.

The service station system uses cleaning agents, where the agents remove at least one of the following materials from a group consisting of ink, ink components, dust particles, and paper fibers.

The present invention also teaches a method for cleaning a printhead including the step of distributing a cleaning agent over a printing face of the printhead.

In one embodiment the present invention teaches a method for cleaning a printhead where the method includes spraying a printing face of a printhead with a cleaning agent.

In another embodiment, the invention teaches a method which includes the steps of bringing a service station into proximity with a printhead, spraying a printing face of a printhead with a cleaning agent; and lowering the service station to a level where a wiper of the service station wipes the printing face.

In yet another embodiment, the method for cleaning a printhead further includes the steps of pressing the service station to the printhead and effecting a vacuum. The vacuum causes ink to be discharged from nozzles in the printhead. Finally the method may also include the step of suctioning off the ink that has been discharged. The steps of pressing and suctioning are effected generally prior to the spraying step.

BRIEF DESCRIPTION OF THE DRAWINGS

The present invention will be understood and appreciated more fully from the following description taken in conjunction with the drawings in which.

Similar parts in different figures are given identical numbers throughout.

DETAILED DESCRIPTION OF THE PREFERRED EMBODIMENTS

Figure 1A:
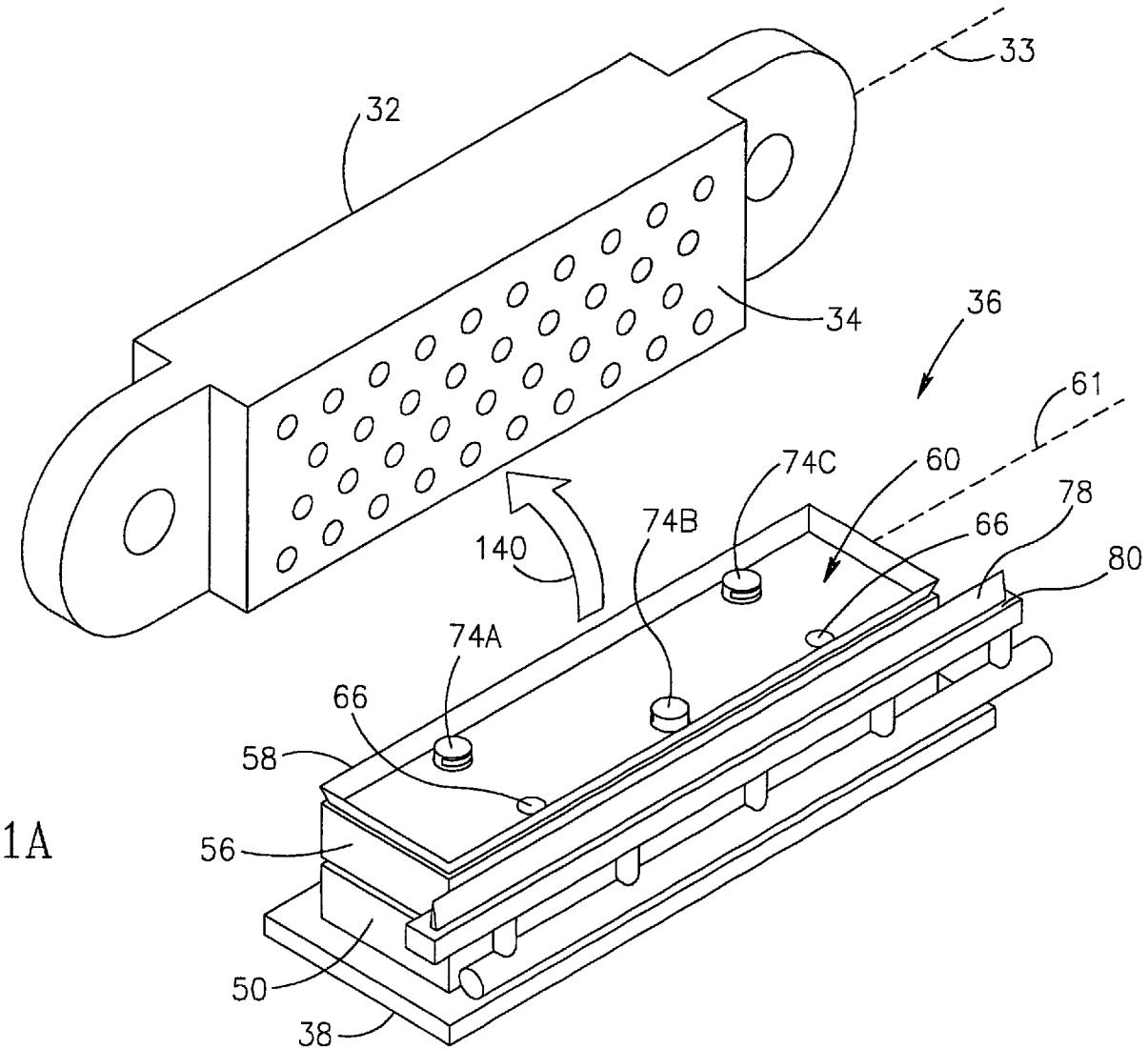
FIGS. 1A, 1B, 1C, 1D and 1E are schematic isometric illustrations of a service station and its associated printhead in five different operational states.

The present invention describes a service station system meant to clean and maintain the nozzle plate of a printhead, preferably an inkjet printhead. It is intended to prevent blockages of, and scratches to, the nozzles which result from dried ink and other contaminants such as dust and paper fibers.

The present invention describes a method for cleaning the nozzle plate of printheads by using at least one sprayer to spray a liquid cleaning agent onto a nozzle plate prior to wiping. The sprayed agent improves the efficiency of cleaning in several ways. It thins any liquid ink left on the nozzle plate and dissolves solid pigment residue stuck to the plate. It decreases the drying rate of fast drying inks and acts as a lubricant for the wiper, generally preventing scratches.

Reference is now made to FIGS. 1A, 1B, 1C, 1D and 1E, where different stages of the operating cycle of a service station 36 of the present invention are shown.

Service station 36 comprises three sprayers 74A, 74B, and 74C, a lower frame 60, an upper frame 56, a base 38, a sponge-covered spittoon 60, an elastomeric lip seal 58, a wiper 78, a drainage basin 80 and pressure release inlets 66. In a working printing machine there will generally be a plurality of service stations 36 lined up in an array, one per printhead 32.

FIG. 1A shows printhead 32 and its underside, nozzle plate 34 before service station 36 is brought into proximity with printhead 32. Service station 36 is in its standby position directly beneath printhead 32. Printhead 32 is shown on its side to better view nozzle plate 34. Generally, nozzle plate 34 is parallel to the plane of spittoon 60 with its long axis 33 also parallel to the long axis 61 of spittoon 60. Service station 36 is raised from its standby position (arrow 140) into a position proximate to nozzle plate 34 before any cleaning of nozzle plate 34 occurs.

Figure 1B:
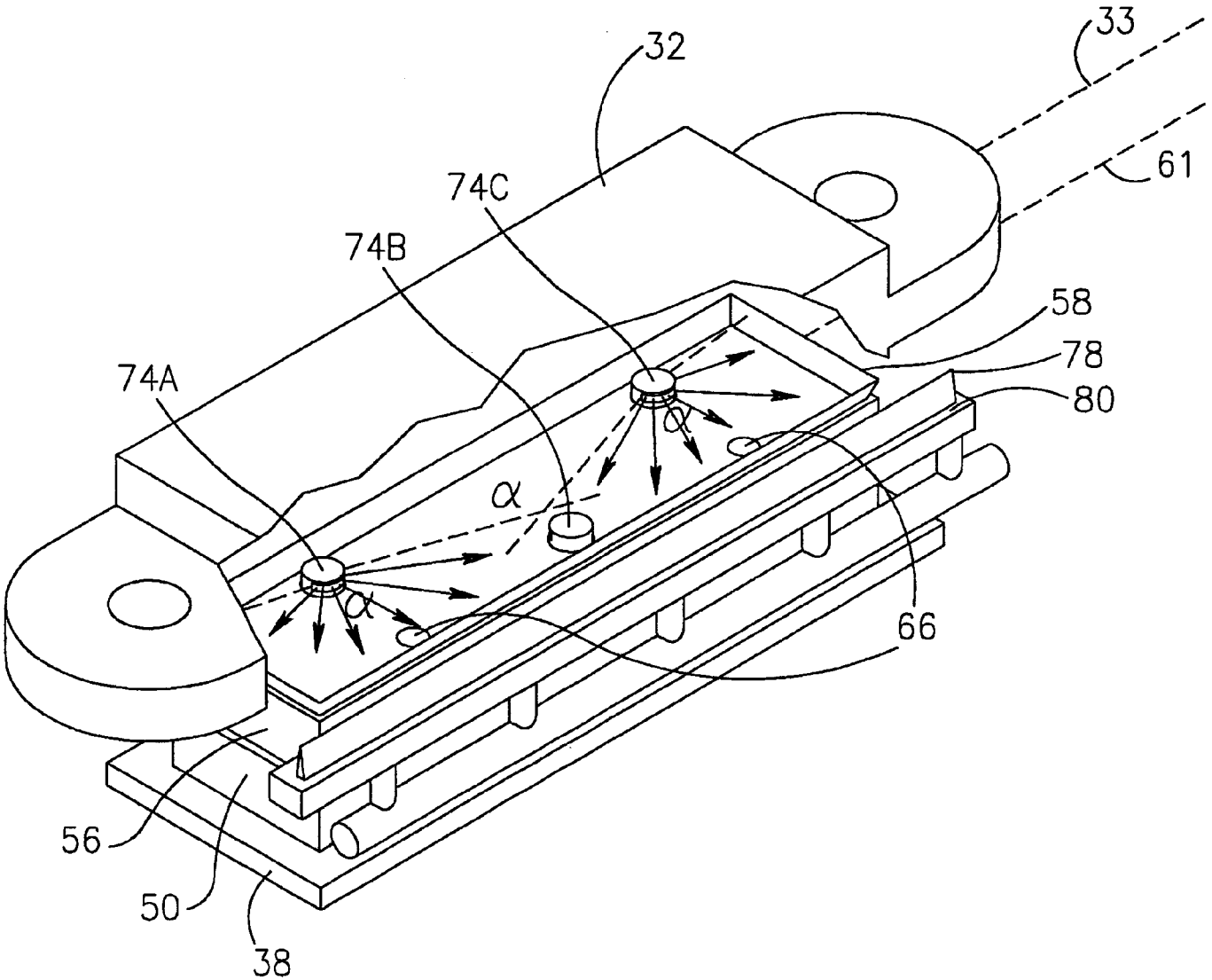

Printhead 32 must be brought from its print position to a position essentially above, and aligned with, service station 36 before the latter is raised. Once station 36 is raised, nozzle plate 34 is joined to lip seal 58 of station 36. As shown in FIG. 1B, the three sprayers 74A, 74B and 74C then spray nozzle plate 34 with a cleaning agent. Sprayers 74A, 74B and 74C are placed as close as possible to the walls of upper frame 56 to maximize the area of nozzle plate 34 which is wetted. As can be seen in FIG. 18, the spray from the two external sprayers 74A and 74C overlap slightly at central sprayer 748. Sprayer 74B is located along the opposite wall of frame 56. Sprayers 74A, 74B, and 74C spray in a lateral direction with a slight upward angle.

Sprayers 74A, 74B, and 74C are located in upper frame 56 and are positioned in such a way that the sprayed cleaning agent from each sprayer wets a different sector of nozzle plate 34. Accurate placement of sprayers 74 ensures that essentially the entire area of nozzle plate 34 is wetted. A typical spraying angle $\alpha$ (best seen in FIGS. 1B and 1C) of 160° can be used. This angle wets an approximate maximum area of nozzle plate 34. The number of sprayers 74 can be more or less than three, depending on their type, dimensions, placement, the amount of cleaning agent sprayed, the area to be wiped, etc.

Figure 1C:
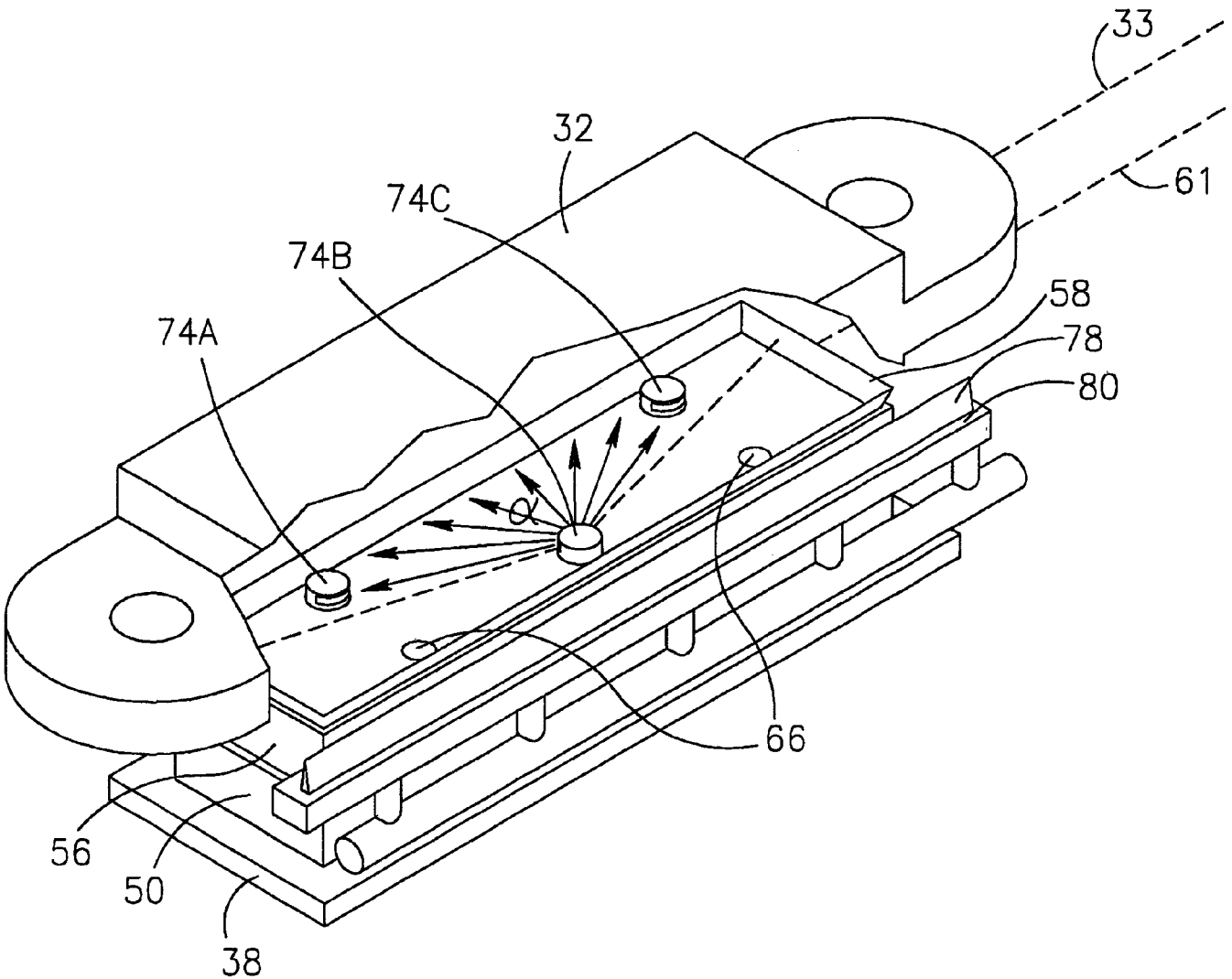

FIG. 1C shows spraying from sprayer 74B, the latter located at the opposite wall of frame 56 The three sprayers 74A, 74B and 74C are synchronized so that they do not operate simultaneously. In that way, the spray from sprayers positioned along opposite walls of service station 36 do not interfere with each other.

Figure 1D:
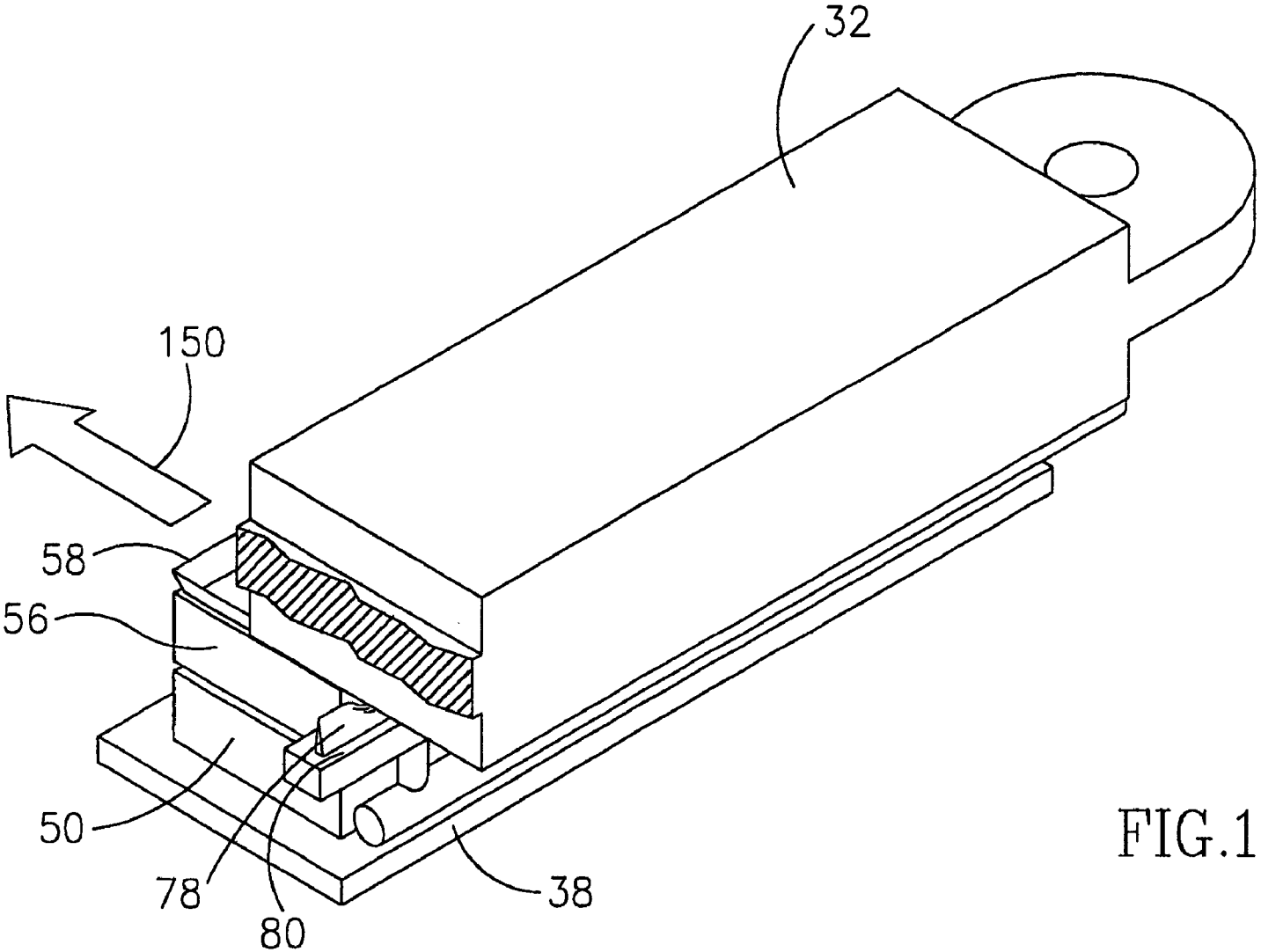

After nozzle plate 34 has been wetted with the cleaning agent, service station 36 is lowered slightly to its wiping position (not shown). As shown in FIG. 1D, service station 36 is then moved laterally (arrow 150), perpendicular to the long axis 33 of printhead 32. This movement causes wiper 78 to be dragged along the face of nozzle plate 34, removing the cleaning agent and any dissolved ink, ink pigments and solid contaminants. The removed material drops into drainage basin 80.

Figure 1E:
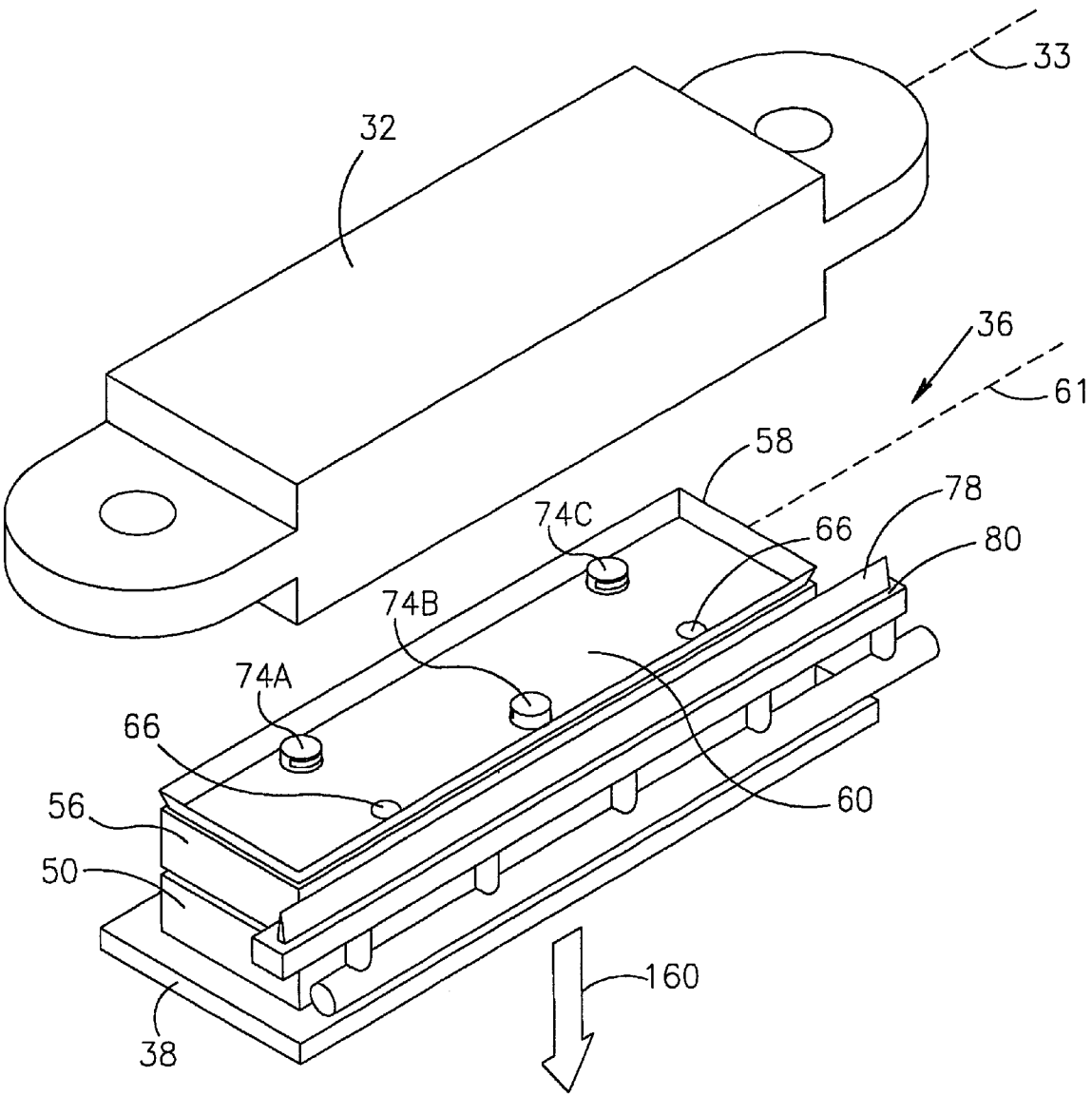

Once the wiping operation is complete, service station 36 is moved downward, as indicated by the arrow 160 in FIG. 1E returning station 36 to its standby position shown in FIG. 1A.

Figure 2:
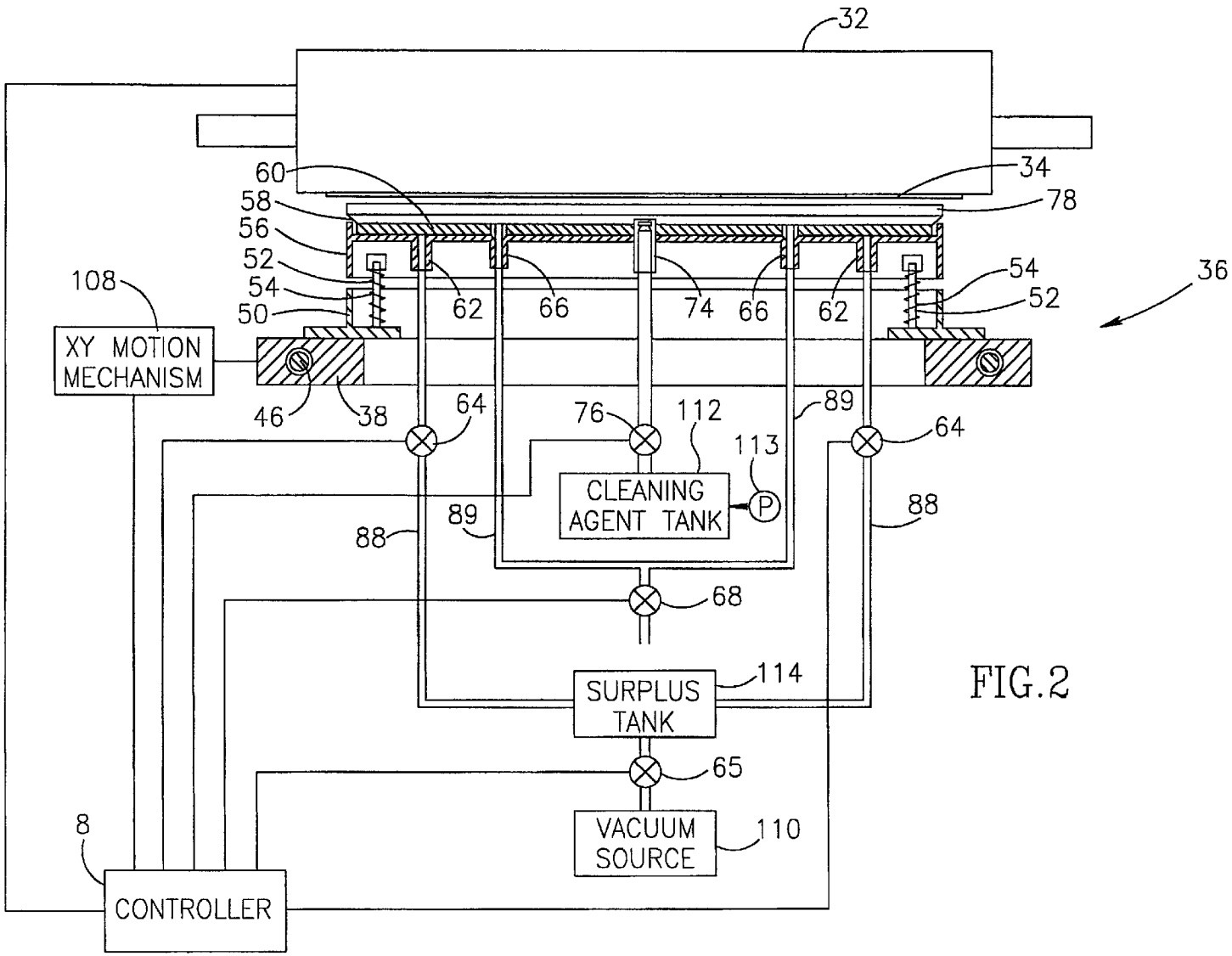
FIG. 2 is a front view illustration of the service station and printhead of FIG. 1A.
Figure 3:
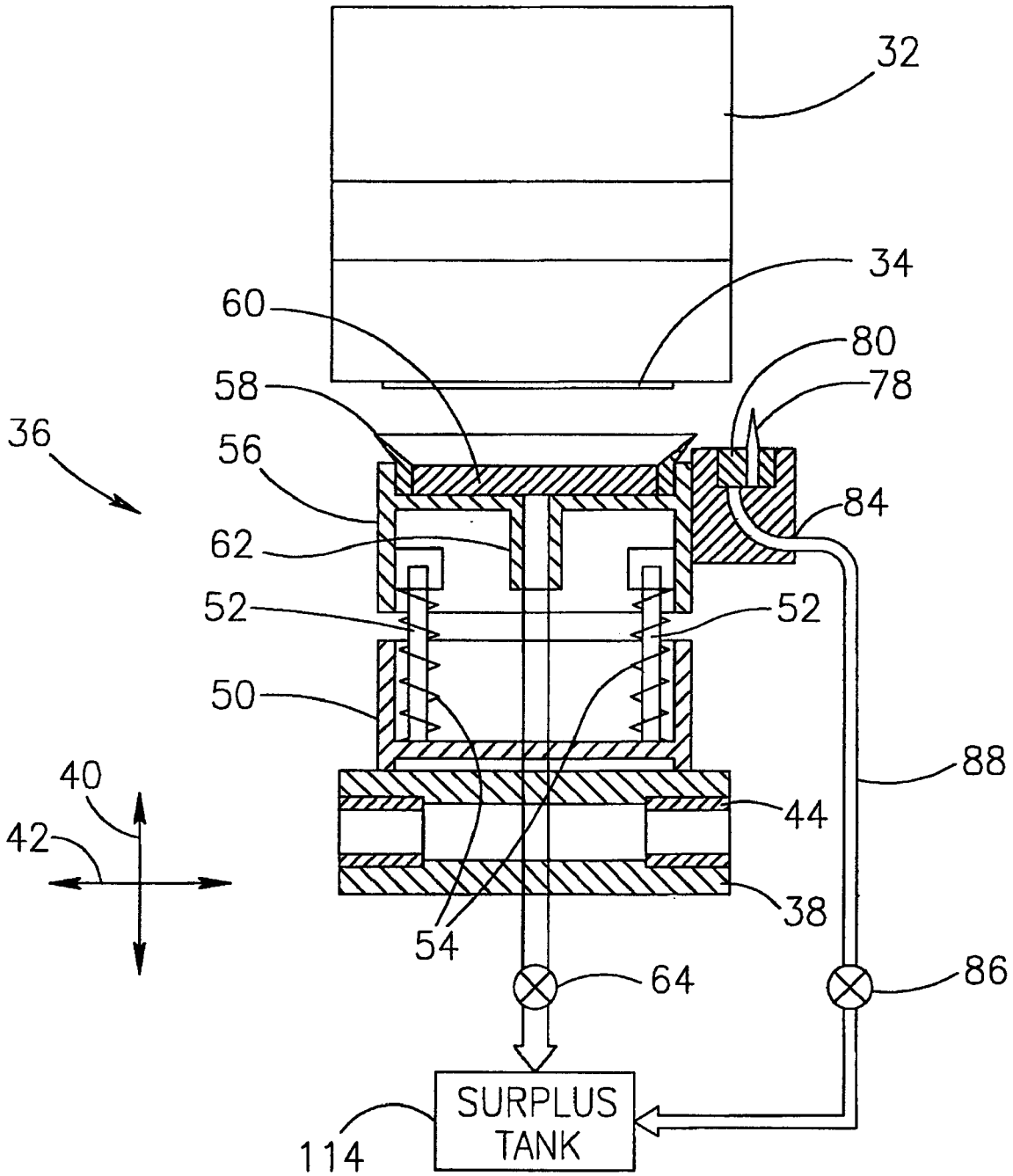
FIG. 3 is a side view illustration of the service station and printhead of FIG. 1A.

Reference is now made to FIGS. 2 and 3, where front and side views of service station 36 and printhead 32 are illustrated, and additional features of the system can be seen. Specifically, FIG. 2 contains the following features previously encountered: printhead 32, nozzle plate 34, wiper 78, sponge-covered spittoon 60, sprayer 74, lip seal 58, pressure release inlets 66, base 38, lower frame 50 and upper frame 56. Features which appear here for the first time are springs 52, connecting pins 54, drainage outlets 62, drainage valves 64, a pressure release valve 68, which opens and closes a path between the seal and atmosphere, a vacuum valve 65, a sprayer valve 76, a surplus tank 114, a cleaning agent tank 112, a vacuum source 110, a pressure source 113, rods 46, a controller 8, and an XY motion mechanism 108. Because of the view, only one of the three sprayers (74A, 74B, 74C) is shown. As shown in FIG. 2, sprayer 74 sits above the sponge in spittoon 60, drainage outlets 62 usually sit below it and pressure release inlets 66 are generally approximately co-terminus with the top of the sponge.

FIG. 3 show s the following additional parts of the service station 36: bushings 44, a drainage basin 80 for wiper 78, a drainage basin outlet 84 and a drainage basin valve 86. FIG. 3 also illustrates the two directions in which service station 36 moves at the command of XY motion mechanism 108, the latter being controlled by controller 8.

Referring to FIGS. 2 and 3, additional details of the operation of service station 36 will now be explained. Aspects of raising and lowering, sealing and "purging" the service station will be discussed.

Upper frame 56, lower frame 50 and base 38 assume three different positions during the operating cycle of the service station system. Moving from the position in which base 38 and frames 50 and 56 are in their lowest position to their highest position, these are:

a) a standby position (shown in FIG. 1A);

b) a wiping position (shown in FIG. 1D and FIG. 3); and c) a sealing position in which elastomeric lip seal 58 is pressed tightly against printhead 32 (shown in FIG. 2).

Frames 50 and 56 are moved to their different positions by XY motion mechanism 108, which is controlled by controller 8 shown in FIG. 2. As indicated in FIG. 3, frames 50 and 56 and base 38 are movable horizontally in direction 42, on bushings 44 which slide on rods 46 (the latter are best seen in FIG. 2). XY motion mechanism 108 also translates frames 50 and 56 in the vertical direction 40.

Lower frame 50, which includes vertical pins 62 and compression springs 54, is assembled on base 38. Upper frame 56 is slideable on pins 52 and rests on springs 54. Lip seal 58, typically made from an elastomeric material, sits on the periphery of upper frame 56. When frames 50 and 56 are raised, lip seal 58 encloses a volume formed by nozzle plate 34, upper frame 56 and spittoon 60. As contact is made between nozzle plate 34 and lip seal 58, upper frame 56 is pushed down on pins 52. A counteracting force exerted by springs 54 is created which generates a tight seal between lip seal 58 and nozzle plate 34.

While in this sealing position, nozzle plate 34 is close to, but does not touch, sprayers 74A, 74B and 74C, or spittoon 60. Pressure release inlets 66 are connected via a tube 89 through electrically operated pressure release valves 68 to the atmosphere. These valves are opened to prevent the formation of an overpressure in the enclosed volume created by lip seal 58. Controller 8 controls pressure release valves 68 during the sealing step just described.

After this tight seal is formed, vacuum source 110 through vacuum valve 65, tubes 88, electrically operated drainage valves 64 and drainage outlets 62 creates a vacuum. The vacuum draws ink through the nozzle apertures of nozzle plate 34 This process is known as purging. The ejected ink is received in the sponge-covered spittoon 60 and withdrawn through the drainage inlets 62 via drainage valves 64 to surplus tank 114. Controller 8 controls vacuum valve 65 and drainage valves 64.

After the printhead has been purged, a cleaning liquid agent from cleaning agent tank 112 is supplied under pressure from pressure source 113 via sprayer valve 76 to sprayers 74A, 74B and 74C The spraying operation, the sprayers, and their placement have already been described above.

The wiping action is performed by lowering base 38 and frames 50 and 56 (direction 40 in FIG. 3) to the wiping level and moving base 38 and frames 50 and 56 horizontally (direction 42 in FIG. 3), such that wiper 78 moves across nozzle plate 34. Ink residue and cleaning agents collected in drainage basin 80 are drained via drainage basin outlet 84, drainage tube 88, and drainage basin valve 86 to surplus tank 114.

Figure 4:
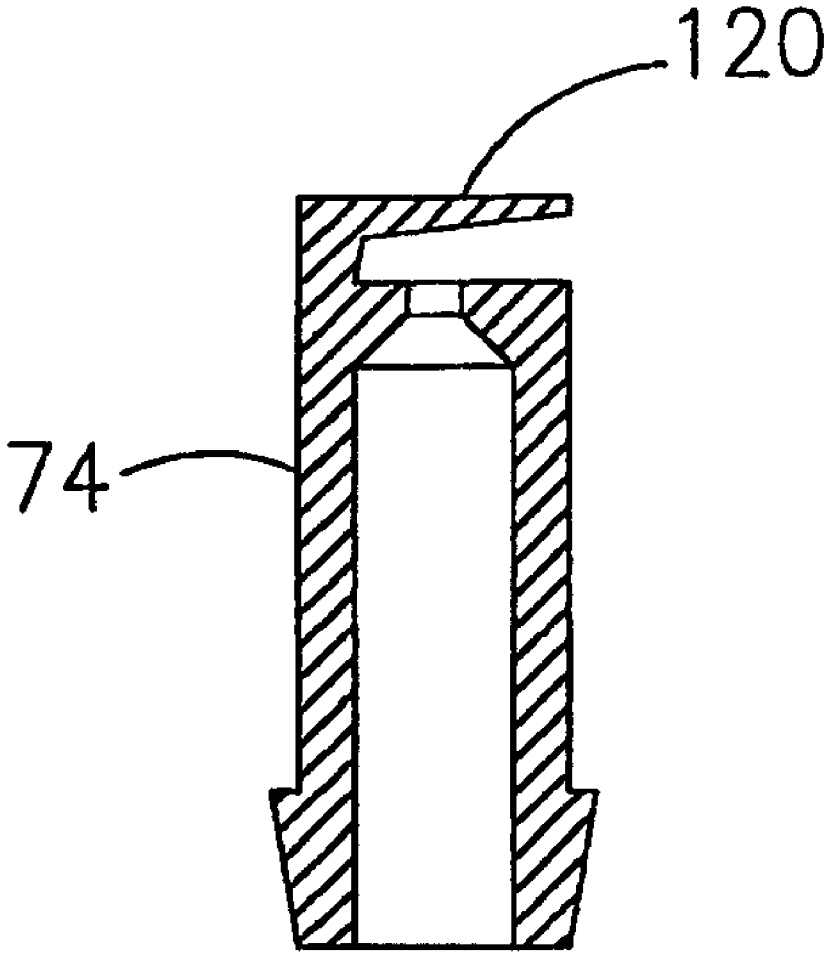
FIG. 4 is a sectional illustration through a typical sprayer forming part of the service station in FIG. 1A.

Reference is now made to FIG. 4, where a sectional view of sprayer 74 is shown. The sprayer 74 contains a bent cap 120, which directs the cleaning agent being sprayed into a given spray angle. The formulation of the cleaning agent is matched to the ink formulation used. For some ink formulations, plain water is an adequate cleaning agent, while for others anti-foaming agents and/or other additives are required.

Controller 8, through its electronic control of sprayer valve 76, controls the quantity of cleaning agent sprayed. Controller 8 also controls, among other things, the spray pressure and the duration of spraying. Typical values of these parameters are a spray pressure of about 3 atmospheres for a duration of about 0.1 sec.

Figure 5:
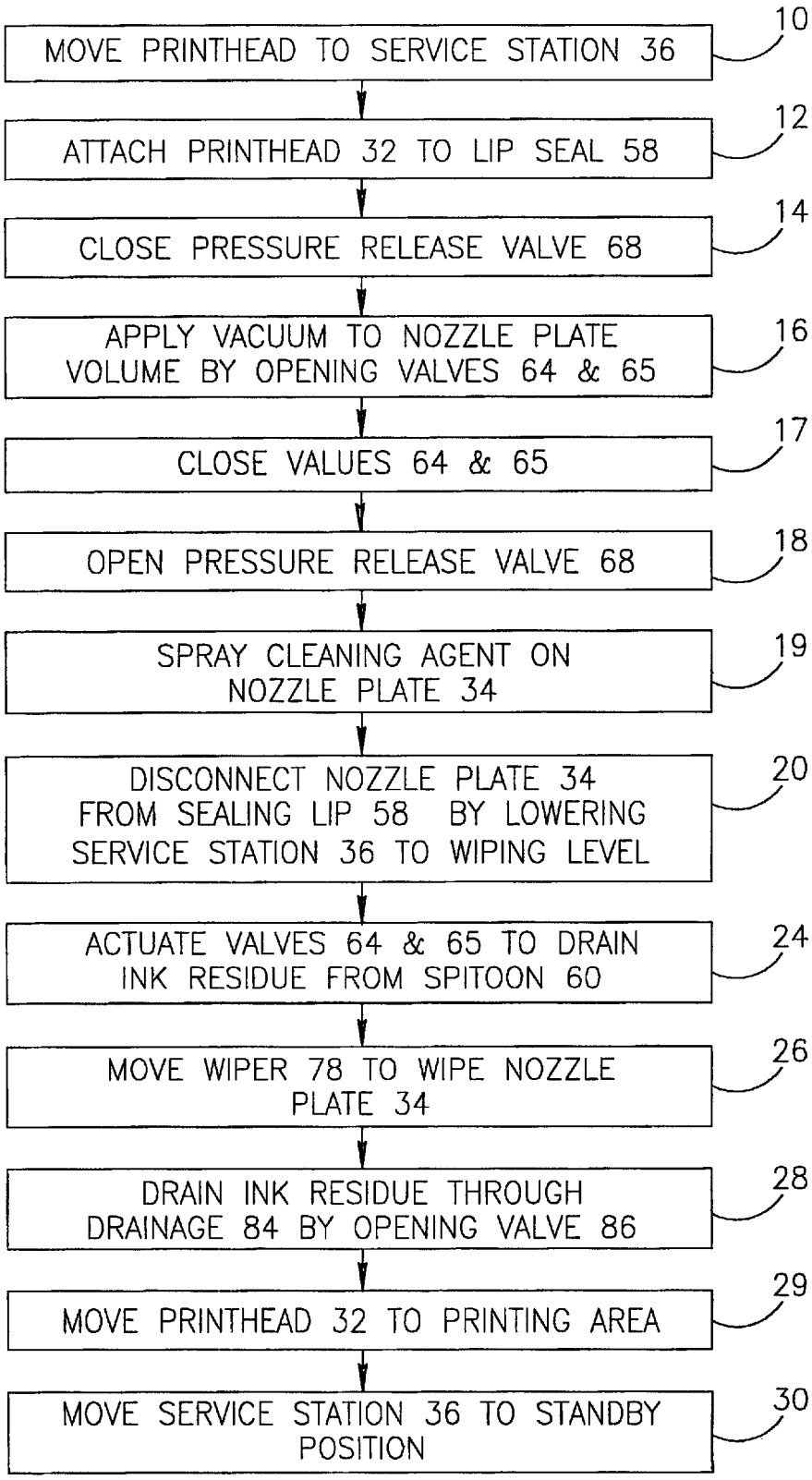
FIG. 5 is a block diagram illustration of the sequence of operations performed by the service station of the present invention.

Reference is now made to FIG. 5 where a block diagram of the operating cycle of service station 36 is shown and which outlines the operational steps of the system. Electronic controller 8 of FIG. 2, which typically is an integral part of the printing machine controller, controls the various steps in the cycle.

As shown in FIG. 5, a typical service cycle commences by moving printhead 32 from the printing area in a horizontal direction to a position directly above service station 36. Frames 50 and 56 and base 38 remain at their standby level while printhead 32 is moved (step 10) into its service position.

Frames 50 and 56 and base 38 are then raised in direction 40 of FIG. 3 to their sealing level (FIG. 1A), while pressure release valve 68 remains open. At the sealing level, lip seal 58 is pressed tightly (step 12) against printhead 32. Keeping pressure release valve 68 open during step 12 prevents a buildup of pressure in the enclosed volume formed between lip seal 58, nozzle plate 34 and spittoon 60.

Pressure release valve 68 is closed (step 14) while drainage valves 64 and sprayer valve 76 remain in their closed position. After drainage valves 64 and vacuum valve 65 are opened (step 16), a vacuum is applied through drainage outlets 62 to nozzle plate 34 and the above-mentioned enclosed volume. The vacuum causes ink to flow, the "purging" step, from the nozzles of nozzle plate 34 into sponge-covered spittoon 60. This brings fresh ink to nozzle plate 34 of printhead 32 and helps to dislodge any solidified ink residues. After drainage valves 64 and vacuum valve 65 are closed (step 17), pressure release valves 68 are opened (step 18). Nozzle plate 34 is then disconnected (step 19) from sealing lip 58 of service station 36, and station 36 is moved downward.

In step 20, sprayer valve 76 is opened and a cleaning agent from cleaning agent tank 112 is sprayed under pressure supplied by pressure source 113 through sprayers 74 onto nozzle plate 34. Frames 50 and 56 and base 38 of service station 36 are then lowered in direction 40 of FIG. 3 to their wiping position (step 22), followed by opening drainage valves 64 and vacuum valve 65 which drain spittoon 60 via drainage inlets 62 (step 24).

Frames 56 and 58 and base 38 are moved (step 26) in the horizontal direction 42 as shown in FIG. 3, causing wiper 78 to wipe any ink residue from nozzle plate 34. The wiped ink residue is then drained (step 28) from drainage basin 80 through drainage basin outlet 84, drainage tube 88, drainage basin valve 86 to surplus tank 114. Steps 26 and 28 occur essentially simultaneously.

Printhead 32 is then moved (step 29) to the printing area. Frames 50 and 56 and base 38 of service station 36 are then lowered (step 30) in direction 40 of FIG. 3 to their standby position completing the operating cycle.

While in the above embodiment, wiper 78 moves across the face of stationary nozzle plate 34, in another embodiment, wiper 78 is held stationary and printhead 32 moves across wiper 78. Similarly, in the above embodiment, service station 36 is moved up to the level of nozzle plate 34 on printhead 32 and later lowered; in another embodiment service station 36 is held stationary while printhead 32 is lowered and later raised.

It will be appreciated by persons skilled in the art that the present invention is not limited to what has been particularly shown and described hereinabove. Rather the scope of the present invention is defined only by the claims that follow:

What is claimed is:

1. A service station for cleaning a print head, the station comprising:

a body having a seal attached thereto, one or more sprayers attached to said body within an area demarcated by said seal, said sprayers each having a bent cap able to spray a cleaning agent at a predetermined spray angle over a nozzle plate of said print head when said seal, said body and said nozzle plate are positioned to form an enclosed volume, said sprayers positioned so that substantially all of said nozzle plate will be wetted by said cleaning agent; and a pressure release valve able to keep the pressure within said enclosed volume at atmospheric level during spraying.

2. The service station of claim 1, wherein said print head is an inkjet print head.

3. The service station of claim 1, further comprising a controller able to control said pressure release valve.

4. The service station of claim 2, wherein said controller is further able to control the amount of said cleaning agent sprayed, the duration of said spraying and the pressure of said spraying.

5. The service station of claim 1, further comprising one or more drainage valves able to remove said cleaning agent from said enclosed volume.

6. The service station of claim 1, wherein said cleaning agent when sprayed under pressure is able to remove from said nozzle plate at least a portion of at least one of ink, ink components, dust particles and paper fibers.

7. The service station of claim 6, wherein said cleaning agent is able to thin liquid ink left on said nozzle plate, to dissolve solid pigment residue stick to said nozzle plate, to decrease the drying rate of fast drying inks and to act as a lubricant for a wiper, said wiper is able to wipe said cleaning agent off said nozzle plate.

* * * * *